US007064634B1

(12) United States Patent
Wehrli, III et al.

(10) Patent No.: US 7,064,634 B1
(45) Date of Patent: Jun. 20, 2006

(54) SHOCK RESISTANT ACTUATORS FOR A CIRCUIT BREAKER

(75) Inventors: Henry Anthony Wehrli, III, Monroeville, PA (US); William John Jones, Cranberry Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/158,461

(22) Filed: Jun. 22, 2005

(51) Int. Cl.
*H01H 75/00* (2006.01)
*H01H 3/60* (2006.01)
*H01H 9/00* (2006.01)

(52) U.S. Cl. ..... 335/6; 335/26; 335/27; 335/157

(58) Field of Classification Search ..... 335/6, 335/21, 26, 27, 157, 172–176
See application file for complete search history.

(56) References Cited

U.S. PATENT DOCUMENTS

| | | | |
|---|---|---|---|
| 4,001,740 | A | 1/1977 | MacLean |
| 4,106,072 | A | 8/1978 | MacLean |
| 4,133,020 | A | 1/1979 | MacLean |
| 4,639,700 | A | 1/1987 | Shestak et al. |
| 5,321,376 | A | 6/1994 | MacLean |
| 5,343,179 | A | 8/1994 | Pipich et al. |
| 6,072,136 | A | 6/2000 | Wehrli, III et al. |

*Primary Examiner*—Ramon M. Barrera
(74) *Attorney, Agent, or Firm*—Martin J. Moran

(57) ABSTRACT

A linkage for a solenoid actuated circuit breaker operating mechanism is provided. The operating mechanism includes a trip device and a close device. Either the trip device or the close device is coupled to a solenoid, by an ultra-lightweight connection member. The ultra-lightweight connection member is so light as to not create a sufficient force to effect the trip device or the close device even when the circuit breaker is subjected to a shock load.

20 Claims, 4 Drawing Sheets

SHOCK RESISTANT ACTUATORS FOR A CIRCUIT BREAKER

BACKGROUND OF THE INVENTION

1. Field of the Invention

The present invention relates to a circuit breaker having an operating mechanism with a solenoid actuated trip device and close device and, more specifically, to solenoids coupled to their respective devices by an ultra-lightweight member.

2. Background Information

Electrical switching apparatus for opening and closing electric power circuits typically utilize an energy storage device in the form of one or more large springs to open and close the contacts of the device. Such electrical switching apparatus includes power circuit breakers and network protectors, and electric switches which are used to energize and deenergize parts of the circuit or to transfer between alternative power sources. These devices will be identified jointly by the phrase "circuit breaker" hereinafter. The circuit breaker includes an operating mechanism and a control system. The operating mechanism further includes a trip device and a close device. The trip device has an open spring, or springs, which rapidly separate the contacts to interrupt current flowing in the power circuit. The close device has one or more large springs to close the contacts of the device into the large currents which can be drawn in such circuits. The control system is structured to provide instruction to the trip device and the close device.

One known system for actuating the trip device and the close device included a linear solenoid 1 having a plunger 2, as shown in FIG. 1. The solenoids were coupled to the control system and when an open or close instruction was provided, the control system would activate the proper solenoid causing the plunger to move which, in turn, would actuate either the trip device or the close device on the operating mechanism. While the use of linear solenoids is ideal for many conditions in which circuit breakers are used, there are environments where the use of a plunger is detrimental. That is, in situations where the circuit breaker is subjected to shock loads, the mass of the plunger may cause the plunger to move, and therefore actuate the trip/close device, unintentionally. Shock loads, e.g. an impact, may occur where a circuit breaker is located on a vehicle such as, but not limited to, a boat or ship. These shock loads may cause an acceleration up to, or beyond, 300 g, for a very brief period of time. Thus, under a shock load, a plunger having a mass of 100 grams could exert a force of 3 kilograms. This force could be enough to cause the plunger to move as if the solenoid were activated. Thus, the shock load could cause the circuit breaker to trip, or close, accidentally.

There is, therefore, a need for a circuit breaker having a linkage between a solenoid and a trip device and/or a close device, wherein the linkage is ultra-lightweight.

There is a further need for a solenoid for a circuit breaker trip device and/or a close device that is structured to not be actuated under a shock load.

SUMMARY OF THE INVENTION

These needs and others are met by the present invention which provides for an operating mechanism having a trip device and/or a close device coupled to a rotary solenoid by an ultra-lightweight linkage. The linkage is, preferably, a tension member such as a multi-filament, flexible steel wire. The rotary solenoids are structured to be adjustably balanced and be spring biased to a start position. The rotary solenoids may have a blade coupled to the rotating pin so as to provide a sufficient range of motion so as to actuate the trip or close devices. The tension member extends between a rotary solenoid blade and either the trip device or the close device. The spring biases the blade to the start position wherein the tension member is straight, but not taut. Thus, when the circuit breaker control system receives an open or close instruction, the respective rotary solenoid is activated causing the blade to rotate in a direction that puts the tension member in tension which, in turn, applies a force to either the trip device or the close device, thereby actuating the trip device or the close device.

The linkage preferably weighs between 1.0 and 2.0 grams, and more preferably 1.5 grams. When the linkage is this light, a 300 g shock load will only create a force of about 0.45 kg. Such a light force is absorbed by the solenoid and the spring without effecting the trip device or the close device. Preferably, the linkage is a thin steel, multi-filament wire with a pull strength of about 50 kg. The linkages of the prior art would not have been made from such a lightweight material as the strength associated with heavier materials was more desirable than a reduced weight.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "shock load" is an impact force in any direction causing a momentary acceleration or deceleration of up to about 300 g.

As used herein, the phrase "ultra-lightweight" means having a weight of less than about 3 grams.

As used herein, the phrase "effective force" means the amount of force that must be applied to a trip device or a close device to cause the trip device or close device to be activated.

As used herein, the phrase "relatively-massless" means an element has a sufficiently small mass so that, even under a shock load, the element cannot create an effective force.

As used herein, the phrase "tension member" means a member capable of supporting a load while in tension, but which is generally flexible under a compressive force.

Figure 1:
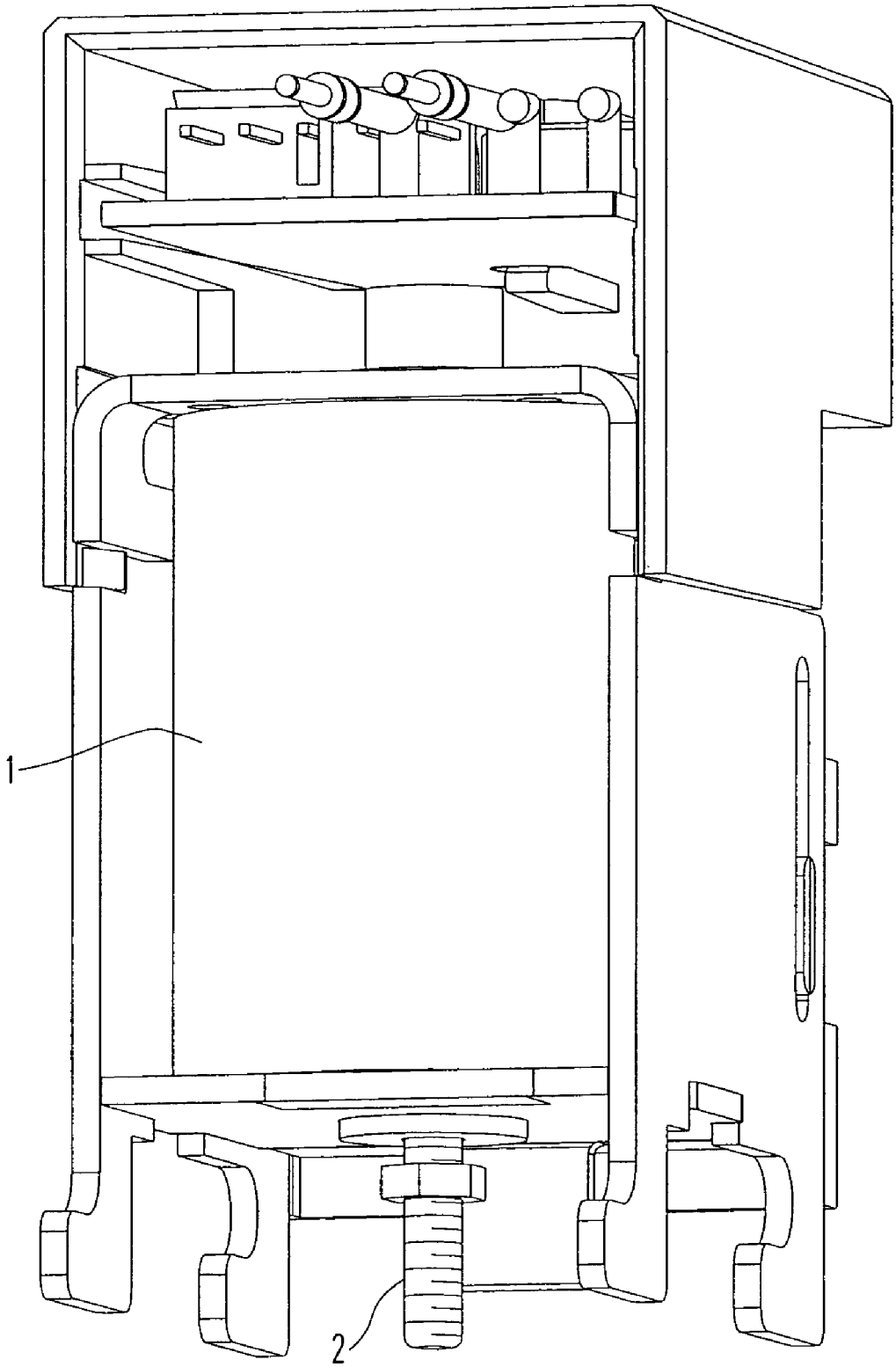
FIG. 1 is a prior art solenoid.
Figure 2:
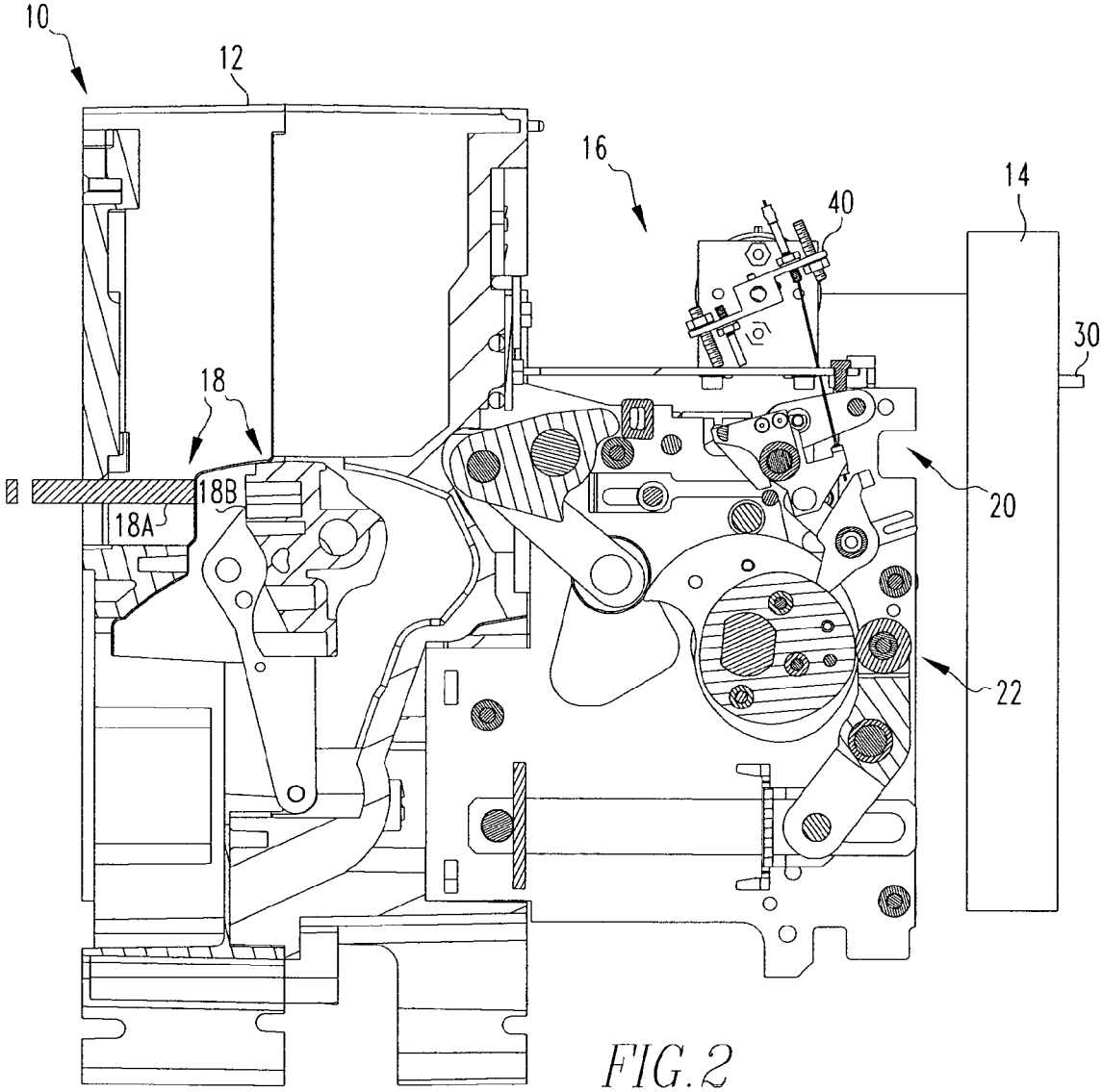
FIG. 2 is an isometric view of a circuit breaker.

As shown in FIG. 2, a circuit breaker 10 includes a housing 12, a control system 14 (shown schematically), an operating mechanism 16, and at least one pair of separable contacts 18. As is known, the separable contacts 18 include a fixed contact 18A and a movable contact 18B. The separable contacts 18 are structured to move between a first, closed position, wherein the fixed contact 18A and movable contact 18B are in electrical communication, and a second, open position, wherein the fixed contact 18A and movable contact 18B are not in electrical communication.

The operating mechanism 16 is structured to actuate, that is, open or close, the separable contacts 18. The operating mechanism 16 includes a trip device 20 and a close device 22. The trip device 20 and the close device 22 each utilize one or more springs 62 in order to accomplish the movement of the separable contacts 18. An operating mechanism 16 suitable for use with the invention claimed herein is disclosed in U.S. Pat. No. 6,072,136, which is incorporated by reference. U.S. Pat. No. 6,072,136 provides a full description of the charging mechanism, as well as various other components of the circuit breaker 10, which are not relevant to the present invention. Generally, the trip device 20 is structured to move the separable contacts 18 from the first position to the second position. The close device 22 is structured to move the separable contacts 18 from the second position to the first position. The trip device 20 is structured to be actuated manually or when a trip condition occurs. The close device 22 is structured to be actuated manually. Manual actuation of the trip device 20 and the close device 22 is accomplished via the control system 14.

Figure 3:
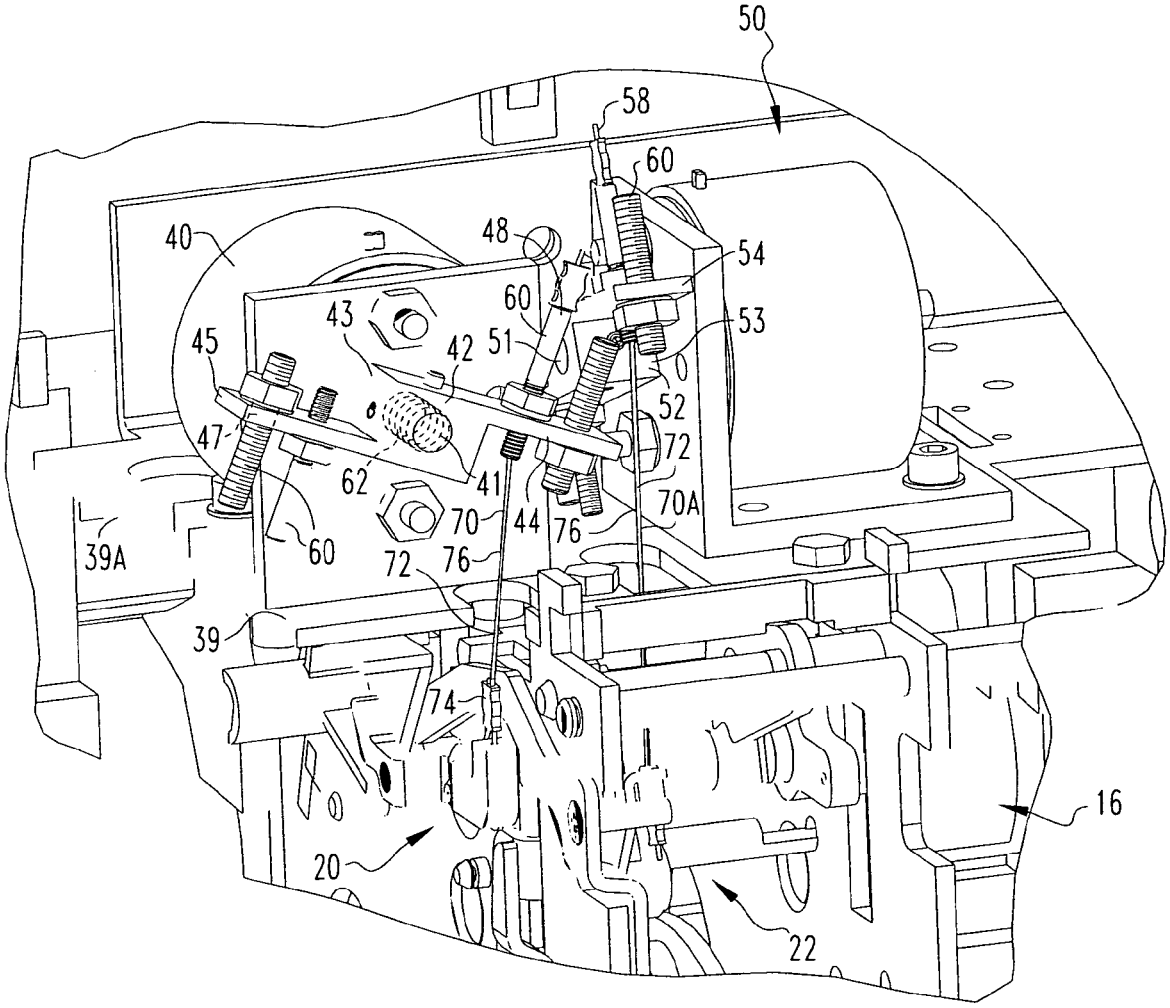
FIG. 3 is an isometric view of two rotary solenoids in a first configuration.
Figure 4:
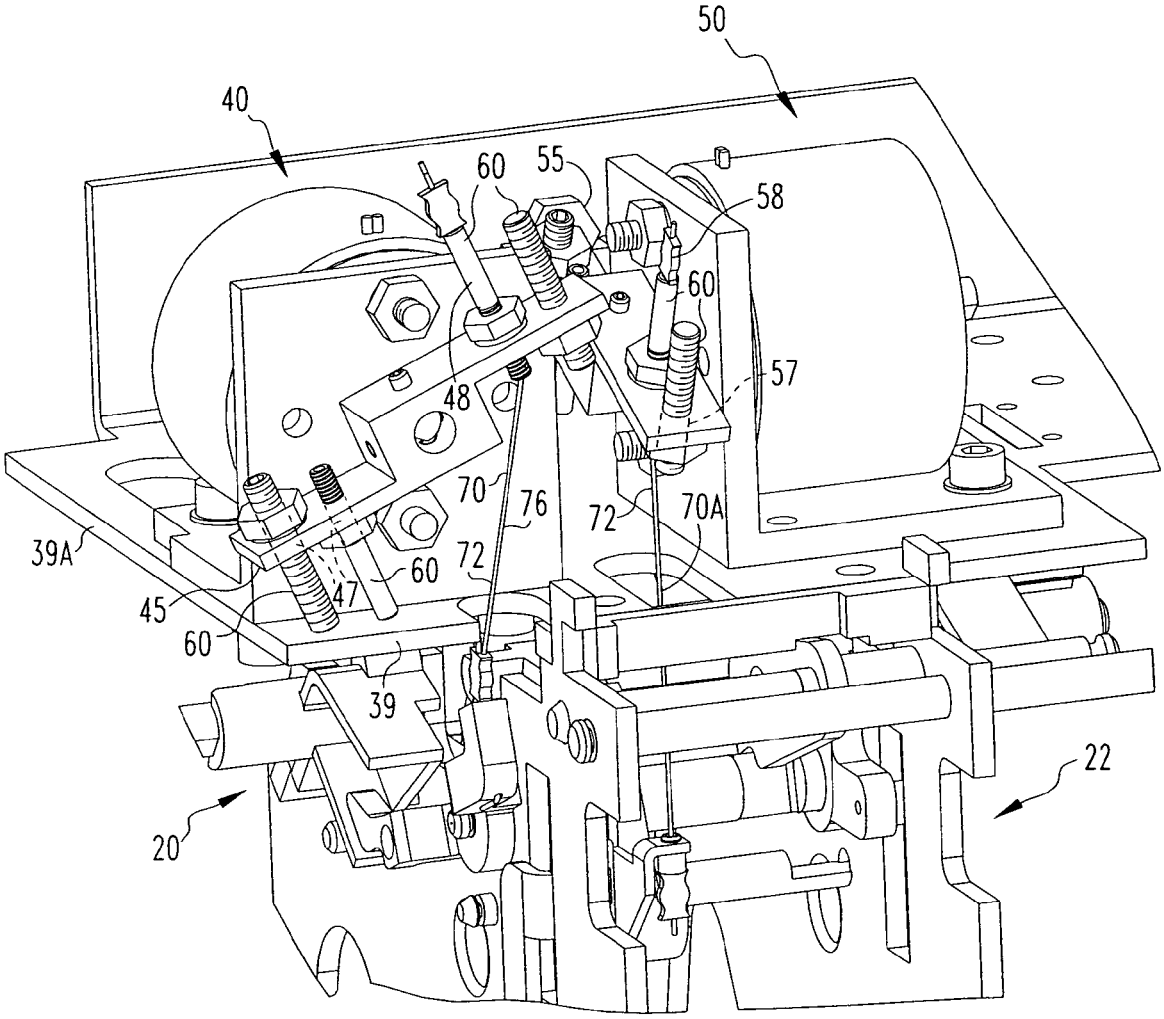
FIG. 4 is an isometric view of two rotary solenoids in a second configuration.

The control system 14 includes a user interface 30, a trip solenoid 40 and a close solenoid 50. The user interface 30 is coupled to a trip solenoid 40 and close solenoid 50 (FIG. 3). The user interface 30 may include buttons, switches, or any other type of input device that allows a user to activate the a trip solenoid 40 and close solenoid 50. When the trip solenoid 40 or close solenoid 50 is activated, that solenoid 40, 50 actuates the associated trip device 20 or close device 22 as described above. As shown in FIGS. 3 and 4, the trip solenoid 40 and close solenoid 50 move in concert with each other and with the separable contacts 18, as will be described below.

The trip solenoid 40 and close solenoid 50 are rotary solenoids each having a rotating pin 41, 51 respectively. As shown in FIGS. 3 and 4, the trip solenoid 40 and close solenoid 50 rotating pins 41, 51 are structured to rotate counter-clockwise when the solenoid 40, 50 is activated. That is, when a charge is applied to either the trip solenoid 40 and close solenoid 50, the respective rotating pin 41, 51 rotates in a counter-clockwise direction from a first position to a second position. Both the trip solenoid 40 and close solenoid 50 further include an elongated blade 42, 52, respectively. Preferably, each blade 42, 52 is balanced about a central axis opening through which the associated pin 41, 51 extends. Each blade 42, 52 includes a center portion 43, 53, a first extension 44, 54 extending from the center portion 43, 53, and a second extension 45, 55 extending from the center portion 43, 53 in a direction generally opposite the first extension 44, 54. Each center portion 43, 53 is coupled in a fixed relation to the respective rotating pin 41, 51. Thus, rotation of either rotating pin 41, 51 causes the attached blade 42, 52 to rotate as well. Each first extension 44, 54, and second extension 45, 55 include at least one opening 47, 57 which may be threaded. Weights 60, which are preferably elongated and threaded, may be disposed through the openings 47, 57. Additionally, at least one weight 60 on each solenoid 40, 50, acts as a connection member mounting 48, 58, respectively. By virtue of the elongated weights 60, which may be variably positioned in the openings 47, 57, the trip solenoid 40 and close solenoid 50 may be substantially balanced. That is, on each blade 42, 52, at least one weight is disposed on either side of the center portion 43, 53 and by adjusting the position of the weights 60 in the openings 47, 57, each blade 42, 52 is substantially balanced on its associated pin 41, 51.

Further, each solenoid 40, 50 is mounted on, or adjacent to, a stop member 39, such as, but not limited to, a plate 39A. The distance each rotating pin 41, 51 may rotate may be limited by an interaction between an elongated weight 60 and a stop member 39. That is, the stop member 39 is positioned so that it is in the path of travel of an elongated weight 60 as the weight 60 moves with the blade 42, 52. Thus, when a solenoid 40, 50 is activated, as described below, the elongated blade 42, 52 will rotate until the elongated weight 60 contacts a stop member 39. Additionally, the trip solenoid 40 and close solenoid 50 may each include a helical spring 62 (shown schematically), disposed about the pins 41, 51 which act to bias the rotating pins 41, 51 in a counter-clockwise direction. The force created by the springs 62 is sufficient to bias the rotating pins 41, 51, and therefore the blades 42, 52, to a start position while not drawing the tension member 76 (described below) taut.

The trip solenoid 40 and close solenoid 50 are coupled, respectively, to the trip device 20 and the close device 22 by a first and second ultra-lightweight linkage 70, 70A. The linkages 70, 70A for the trip device 20 and the close device 22 are substantially similar and will be described using a single set of reference numbers. The linkages 70, 70A may, however, have different physical dimensions such as length. The linkages 70, 70A each include an elongated connection member 72 and at least one connection device 74, such as but not limited to, a loop fastener or catch pin. The connection device 74 is structured to couple the connection member 72 to either the trip device 20 or the close device 22. The end of the connection member 72 opposite the connection device 74 is coupled to the connection member mounting 48, 58 on either the trip solenoid 40 or close solenoid 50. The connection member 72 is, preferably, a tension member 76 such as a wire made from a plurality of steel filaments. The tension member 76 weighs between about 1.0 and 2.0 grams, and more preferably about 1.5 grams.

As noted above, the trip solenoid 40 and close solenoid 50 move in concert with each other as well as with the trip device 20, the close device 22, and the separable contacts 18. During this coordinated movement, the trip solenoid 40 and close solenoid 50 generally move opposite each other. That is, when the trip solenoid 40 is in the first position, the close solenoid 50 is in the second position. For example, under normal operating conditions, the separable contacts 18 are in the first, closed position. When the separable contacts 18 are in the first, closed position, the close solenoid 50 has been activated and the close solenoid rotating pin 51 is in the second position. In this configuration, the trip solenoid rotating pin 41 is in the first position with the tension member 76 generally straight, but not taut, relative to the trip device 20. When an overcurrent condition is detected, or a manual open instruction is provided by the control system 14, the trip solenoid 40 is activated causing the trip solenoid rotating pin 41, and therefore the trip solenoid blade 42, to move into the second position. Movement of the trip solenoid blade 42 is arrested when an elongated weight 60 coupled to the solenoid blade 42 contacts the stop member 39. As the trip solenoid rotating pin 41 moves into the second position, the trip device 20 is actuated and the separable contacts 18 are moved into the second, open position. This action, or an action to charge the close spring, acts to move the close solenoid rotating pin 51 back into the first position. When a close instruction is provided by the control system 14, the close solenoid 50 is activated and the close solenoid rotating pin 51 moves into the second position thereby actuating the close device 22. When the close device 22 is actuated, the separable contacts 18 are moved back into the first closed position and the trip solenoid rotating pin 41 is also moved back into the first position.

The invention described above using an ultra-lightweight connection member 72 is used in connection with heavy circuit breakers 10. The concept, however, is applicable to any size circuit breaker wherein the connection member 72 is relatively-massless as compared to a blade 42, 52 or other structure, such as, but not limited to, a solenoid pin 41, 52, to which the connection member 72 is coupled. The arrangement of the control system 14 is generally similar to the arrangement disclosed above except the weight of the connection member 72 may be greater than, or less than, the defined weight of an ultra-lightweight connection member 72, depending upon the weight of the blade 42, 52 or other structure to which the relatively-massless connection member 72 is coupled.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A linkage for a rotary solenoid actuated circuit breaker operating mechanism, said operating mechanism including a trip device and a close device, at least one of said trip device or close device coupled to at least one solenoid, said circuit breaker having at least one pair of separable contacts, said separable contacts actuated by said operating mechanism, and a control system structured to actuate said at least one solenoid, said linkage comprising an ultra-lightweight connection member extending between, and coupled to each, said rotary solenoid and at least one of said trip device or close device.

2. The linkage of claim 1 wherein said connection member is a tension member.

3. The linkage of claim 2 wherein said tension member is a multi-filament wire.

4. The linkage of claim 3 wherein said tension member is a steel wire.

5. The linkage of claim 2 wherein said tension member is a steel wire.

6. The linkage of claim 2 wherein said tension member weighs between about 1.0 and 2.0 grams.

7. The linkage of claim 2 wherein said tension member weighs about 1.5 grams.

8. An operating mechanism for a circuit breaker, said circuit breaker having a control system and at least one pair of separable contacts, said separable contacts structured to move between a first, closed position, wherein said contacts are in electrical communication, and a second, open position, wherein said contacts are not in electrical communication, said operating mechanism comprising:

a trip device coupled to said separable contacts and structured to move said separable contacts from said first position to said second position;

a close device coupled to said separable contacts and structured to move said separable contacts from said second position to said first position;

a trip solenoid coupled said control system and coupled to, and structured to actuate, said trip device by a first ultra-lightweight connection member; and a close solenoid coupled to said control system and coupled to, and structured to actuate, said close device by a second ultra-lightweight connection member.

9. The operating mechanism of claim 8 wherein:

said trip solenoid is a balanced, rotary solenoid; and said close solenoid is a balanced, rotary solenoid.

10. The operating mechanism of claim 9 wherein:

said trip solenoid has a blade and a rotating pin, said rotating pin structured to move between a first position and a second position, said blade coupled to said rotating pin;

said first connection member extending between, and coupled to, said trip solenoid blade and said trip device;

wherein when said trip solenoid rotating pin moves between said first position and said second position, said trip device is actuated thereby moving said separable contacts from said first position to said second position;

said close solenoid has a blade and a rotating pin, said rotating pin structured to move between a first position and a second position, said blade coupled to said rotating pin;

said second connection member extending between, and coupled to, said close solenoid blade and said close device; and wherein when said close solenoid rotating pin moves between said first position and said second position, said close device is actuated thereby moving said separable contacts from said second position to said first position.

11. The operating mechanism of claim 10 wherein said connection member is a tension member.

12. The operating mechanism of claim 11 wherein said tension member is a multi-filament wire.

13. The operating mechanism of claim 11 wherein said tension member is a steel wire.

14. The operating mechanism of claim 11 wherein said tension member weighs between about 1.0 and 2.0 grams.

15. The operating mechanism of claim 11 wherein said tension member weighs about 1.5 grams.

16. A circuit breaker comprising:

a control system and at least one pair of separable contacts, said separable contacts structured to move between a first, closed position, wherein said contacts are in electrical communication, and a second, open position, wherein said contacts are not in electrical communication;

an operating mechanism having a trip device and a close device;

a trip device coupled to said separable contacts and structured to move said separable contacts from said first position to said second position;

a close device coupled to said separable contacts and structured to move said separable contacts from said second position to said first position;

a trip solenoid coupled to said control system and coupled to, and structured to actuate, said trip device by a first ultra-lightweight connection member; and a close solenoid coupled to said control system and coupled to, and structured to actuate, said close device by a second ultra-lightweight connection member.

17. The circuit breaker of claim 16 wherein:

said trip solenoid is a balanced, rotary solenoid; and said close solenoid is a balanced, rotary solenoid.

18. The operating mechanism of claim 17 wherein:

said trip solenoid has a blade and a rotating pin, said rotating pin structured to move between a first position and a second position, said blade coupled to said rotating pin;

said first connection member extending between, and coupled to, said trip solenoid blade and said trip device;

wherein when said trip solenoid rotating pin moves between said first position and said second position, said trip device is actuated thereby moving said separable contacts from said first position to said second position;

said close solenoid has a blade and a rotating pin, said rotating pin structured to move between a first position and a second position, said blade coupled to said rotating pin;

said second connection member extending between, and coupled to, said close solenoid blade and said close device; and wherein when said close solenoid rotating pin moves between said first position and said second position, said close device is actuated thereby moving said separable contacts from said second position to said first position.

19. An operating mechanism for a circuit breaker, said circuit breaker having a control system and at least one pair of separable contacts, said separable contacts structured to move between a first, closed position, wherein said contacts are in electrical communication, and a second, open position, wherein said contacts are not in electrical communication, said operating mechanism comprising:

a trip device coupled to said separable contacts and structured to move said separable contacts from said first position to said second position;

a close device coupled to said separable contacts and structured to move said separable contacts from said second position to said first position;

a trip solenoid coupled to said control system and coupled to, and structured to actuate, said trip device by a first relatively massless connection member; and a close solenoid coupled to said control system and coupled to, and structured to actuate, said close device by a second relatively massless connection member.

20. The operating mechanism of claim 19 wherein said connection member is a tension member.

* * * * *